US006554100B2

(12) United States Patent
Kim

(10) Patent No.: US 6,554,100 B2
(45) Date of Patent: Apr. 29, 2003

(54) VEHICLE MUFFLER SYSTEM

(76) Inventor: Young Tae Kim, 331-30 Cheonho-Dong, Gangdong-Gu, Seoul (KR)

( * ) Notice: Subject to any disclaimer, the term of this patent is extended or adjusted under 35 U.S.C. 154(b) by 0 days.

(21) Appl. No.: 09/921,872

(22) Filed: Aug. 6, 2001

(65) Prior Publication Data

US 2002/0185334 A1 Dec. 12, 2002

(30) Foreign Application Priority Data

Apr. 30, 2001 (KR) ..... 2001-12560
May 16, 2001 (KR) ..... 2001-26840

(51) Int. Cl.[7] ..... F01N 1/12

(52) U.S. Cl. ..... 181/279; 181/280; 181/277; 181/278

(58) Field of Search ..... 181/279, 241, 181/278, 280, 281

(56) References Cited

U.S. PATENT DOCUMENTS 4,084,658 A * 4/1978 Murphy ..... 181/241
5,892,186 A * 4/1999 Flugger ..... 181/252

* cited by examiner

*Primary Examiner*—Kim Lockett
(74) *Attorney, Agent, or Firm*—Birch, Stewart, Kolasch & Birch, LLP

(57) ABSTRACT

A submuffler for a vehicle muffler system which comprises a housing, a pressure-reducing conduit disposed within said housing, said pressure-reducing conduit containing a plurality of apertures disposed on the surface thereof, an eddy-generating member disposed within the pressure-reducing conduit along a substantial length thereof, and pipe means connected to an inlet side and an exit side of the housing for introducing exhaust gas thereto and exiting exhaust gas therefrom.

10 Claims, 3 Drawing Sheets

VEHICLE MUFFLER SYSTEM

BACKGROUND OF THE INVENTION

1. Field of the Invention

The present invention relates to an improved vehicle muffler system and more particularly to a submuffler combined with a muffler device for use in a vehicle for reinforcing the power of a vehicle engine, whereby the vehicle muffler system increases the exhaust speed of the exhaust gas which is exhausted from the vehicle engine.

2. Description of Related Art

Various types of vehicle mufflers systems are known in the art. Generally, the vehicle is driven by a driving power generated from revolutional movement which is converted from vertical movement utilizing a connecting rod, a crankcase, spark ignition and expansion after the compression of the fuel-air mixture.

As shown in FIG. 1, the conventional vehicle muffler system includes an exhaust manifold 60 operatively connected to a vehicle engine 50 for collecting the combusted exhaust gas. Thereafter, the exhaust gas is transferred through a catalytic converter 70 for reducing the carbon monoxide, the carbohydrate and the nitroxylate using the catalyst in the catalytic converter. The reduced exhaust gas flows into a submuffler 80 for reducing the pressure of the exhaust gas within an open space and then the combustion exhaust gas flows through a plurality of nets or sieves in the main muffler 90 so as to reduce the pressure of the exhaust gas to atmospheric pressure.

However, as the exhaust gas from the exhaust gas manifold 60 and the converter 70 flows through the submuffler 80, it operates to reset the flow and pressure of the exhaust gas, whereby a reduction in the power of the vehicle engine 50 is produced. In addition, the conventional submuffler 80 frequently wears out due to oxidation and rust. Therefore, upon exhausting the combustion exhaust gas through the main muffler 90, the ratio of noise generation and harmful smoke exhaust is increased producing a muffler system which pollutes and contaminates the environment.

SUMMARY OF THE INVENTION

Accordingly, it is an object of the present invention to provide an improved vehicle muffler system which eliminates the above problems encountered with conventional vehicle muffler systems.

Another object of the present invention is to provide a submuffler device for a muffler system used in vehicles for rapidly exhausting the combustion exhaust gas so as to reduce air pressure in the exhaust tube thereof, whereby the submuffler device draws in a large amount of air which is completely combusted for eliminating and reducing air pollution.

A further object of the present invention is to provide a vehicle muffler system which includes a submuffler disposed between the catalytic converter and the main muffler of the vehicle muffler system, the submuffler containing a housing, an insulating material disposed within the housing, a tubular member inserted into the insulating material, a pressure-reducing member containing a plurality of apertures disposed within the tubular member, an eddy-generating member disposed within the pressure-reducing member, a pair of caps connected to both sides of the housing and a resonator disposed between the inside of the tubular member and the outside of the pressure-reducing member.

Still another object of the present invention is to provide a vehicle muffler system which is simple in structure, inexpensive to manufacture, durable in use and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a vehicle muffler system which includes a submuffler containing an eddy-generating member for effectively exhausting exhaust gas which translates to stronger vehicle engine power.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
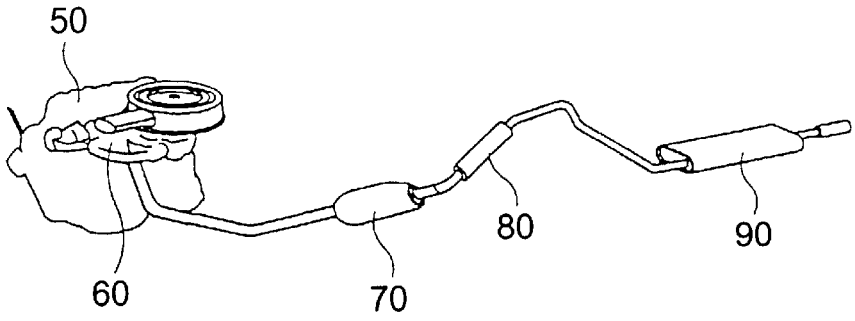
FIG.1 CONVENTIONAL ART
FIG. 1 is a perspective view of a conventional vehicle muffler system.
Figure 2:
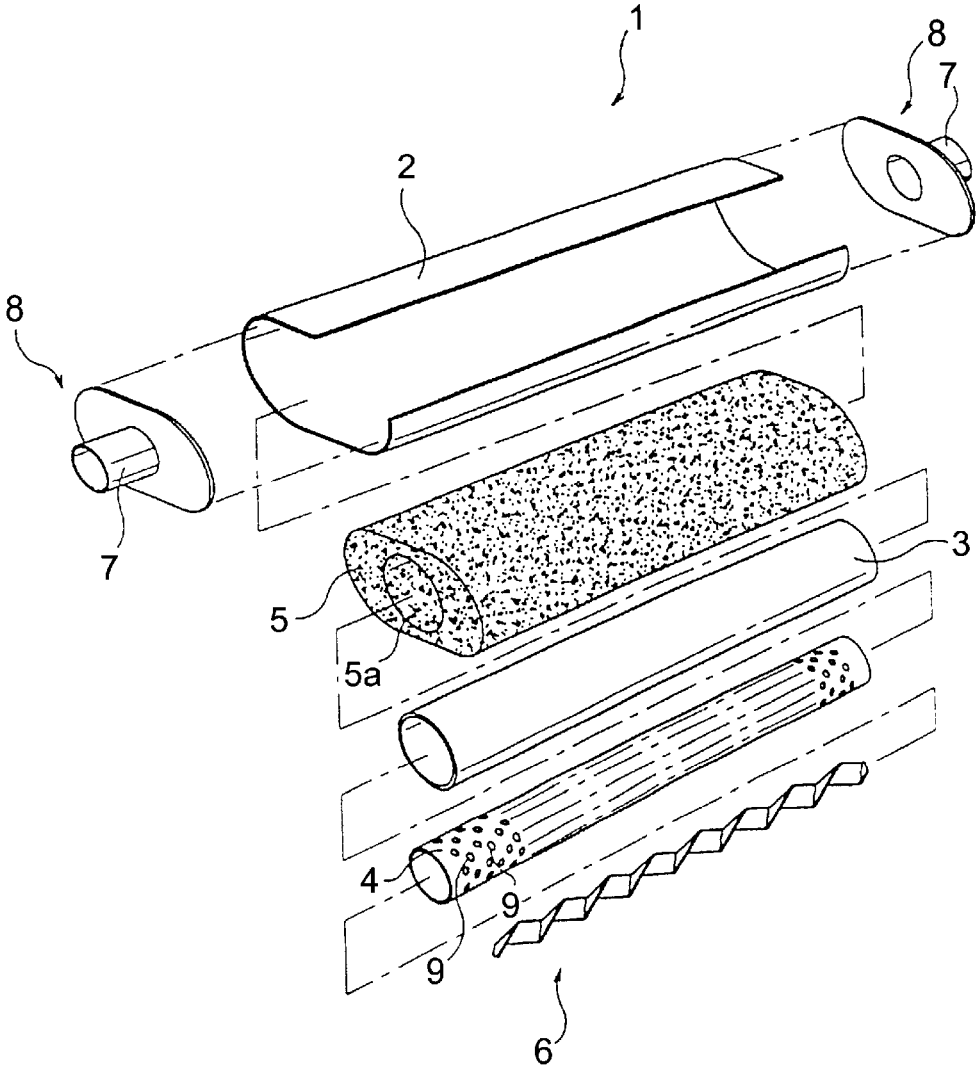
FIG. 2 is an exploded perspective view of a vehicle submuffler utilized in the present invention.
Figure 3:
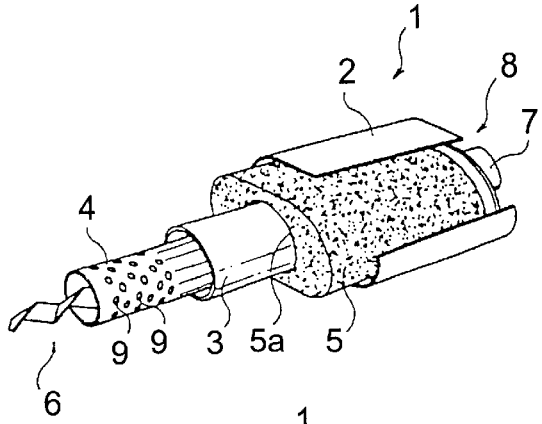
FIG. 3 is a perspective cutaway portion of the submuffler of FIG. 2 illustrating the construction thereof.
Figure 4:
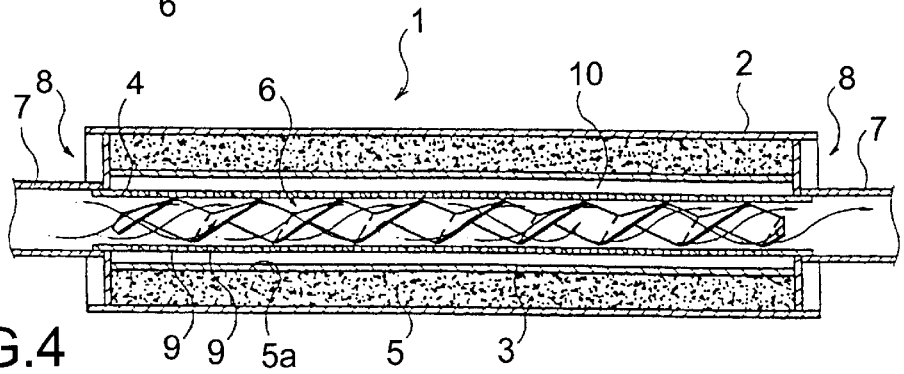
FIG. 4 is a sectional view of the submuffler of the vehicle muffler system according to the present invention.

Referring now in detail to the drawings for the purpose of illustrating the preferred embodiments of the present invention, the vehicle muffler system as shown in FIGS. 2, 3 and 4 comprises a submuffler 1 connected to a catalyst converter 70 and a main muffler 90 (FIG. 1) through a pipe 7.

As shown in FIGS. 2, 3 and 4, the submuffler includes a housing 2 having a pair of caps 8 disposed at both ends thereof, an insulating material disposed within the housing 2, a tubular member 3 inserted into the insulating material, a pressure-reducing pipe 4 containing a plurality of apertures 9 disposed within the tubular member, an eddy-generating member 6 disposed within the pressure-reducing pipe 4 and a resonator zone 10 disposed between an outer surface of the pressure-reducing pipe 4 and the inner surface of the tubular member 3.

The housing 2 has a pair of horizontal surfaces on the top and bottom thereof, respectively. Therefore, the pair of caps 8 has an elliptical configuration. A connecting pipe 7 connects the catalyst converter 70 to the main muffler 90 (FIG. 1). Alternatively, the cap 8 can have a circular configuration.

Figure 6:
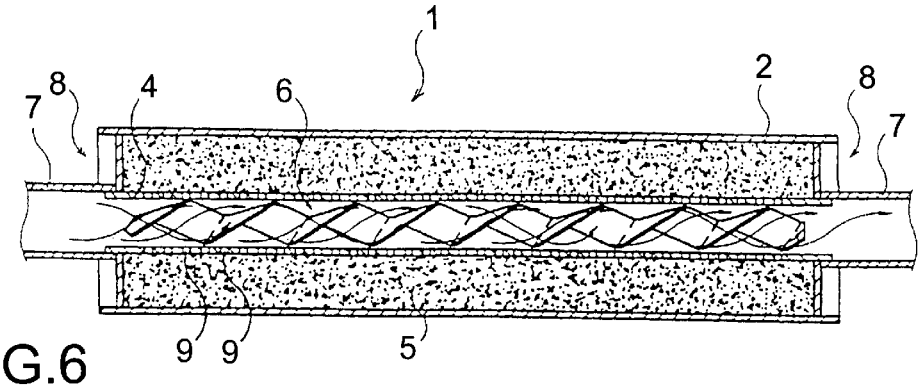
FIG. 6 is a sectional view of a third embodiment of the present invention.

The apertures 9 of the tubular member 3 can have many types of configuration, for example, a cylindrical configuration or a polygonal configuration for preventing particles from migrating from the insulating material into the pressure-reducing pipe 4 as shown in the embodiment of FIG. 6. Also, the tubular member 3 can have a net-type tubular construction.

The pressure-reducing pipe 4 has the plurality of apertures disposed therein for freely communicating air therethrough. Therefore, if the pressure of the exhaust gas therein is high, the exhaust gas flows into the resonator 10 so that pressure of the exhaust gas therein can be reduced. On the contrary, if the pressure of the exhaust-gas disposed in the pressure-reducing pipe 4 is too low, the exhaust gas in the resonator 10 will flow into the pressure-reducing pipe 4, so that the pressure of the pressure-reducing pipe 4 can be controlled to a constant pressure therein which reduces noise.

Referring to FIGS. 2, 3 and 4, the insulating material 5 has an elongated opening 5*a* for receiving the tubular member 3. The insulating material can be, for example, glass fiber or asbestos for preventing the conduction of heat of the exhaust gas travelling through the pressure-reducing pipe 4 to the outside of the housing 2 and from transmitting noise to the outside of the housing 2.

The eddy-generating member 6, due to its configuration, changes the directional flow of the exhaust gas and increases the speed thereof. Thus, the eddy-generating member 6 can have a zig-zag configuration, a serpentine configuration, including one with a plurality of parallel fins, a screw thread configuration, and the like. The eddy-generating member causes the exhaust gas to swirl which increases the exhausting ratio of the exhaust gas which reduces the pressure of the exhaust pipe. The eddy-generating member 6 can be made of stainless steel.

Referring to FIGS. 3 and 4, the vehicle muffler system according to the present invention operates as follows. As shown in FIG. 1, the combustion gas from the vehicle engine 50 collects in the manifold 60. Thereafter, the collected combustion gas travels through the catalyst converter 70 where the combustion gas is reduced. The reduced gas, that is, the exhaust gas is introduced through the pressure-reducing pipe 4 for transmitting the exhaust gas to the resonator 10 through the plurality of apertures 9 so as to reduce the pressure and noise of the exhaust gas within the pressure-reducing member 4 when the pressure and noise of the exhaust gas are too high. On the other hand, when the pressure of the exhaust gas is low, the exhaust gas in the resonator 10 transmits gas into the pressure-reducing member 4 through the plurality of apertures 9.

The eddy-generating member 6 also increases the air flow ratio so as to increase the exhausting efficiency of the exhaust gas. Therefore, the combustion gas can be exhausted quickly from the vehicle engine 50 to the manifold 60, enhancing the combustion of the air-fuel mixture. As a result of the complete combustion of the air-fuel mixture, the power of the vehicle engine 50 is increased as compared to vehicles using a conventional muffler system.

The present invention will now be described in more detail in connection with the following examples which should be considered as being exemplary and not limiting the present invention.

EXAMPLE 1

Conventional Vehicle Muffler System

A vehicle is driven using a conventional vehicle muffler system to test the changing ratios (Cm) of the pedal, the rotation number (rpm) and the fuel expense (Km/l) as shown in Table 1.

TABLE 1

| Changing Ratio of Pedal (Cm) | Rotation Number (rpm) | Fuel Expense (Km/l) |
|---|---|---|
| 0.5 | 1000–1400 | 8.25 |
| 1.0 | 1400–1800 | 9.5 |
| 1.5 | 1800–2000 | 10.0 |
| 2.0 | 2000–2400 | 11.9 |
| 2.5 | 2400–2800 | 8.5 |
| 3.0 | 2800–3200 | 7.0 |
| 3.5 | 3200–4000 | 6.0 |

Thus, when the driver depresses the accelerator pedal to a depth of 0.5 Cm, the number of rotations increases to 1400 rpm and gradually increases according to the depth of the pedal depression. When the accelerator pedal moves to a depth of 1.5–2.0 Cm, the fuel expense increases to a maximum of 10.0~11.9 Km/l. When exceeding 2.5 Cm of accelerator pedal compression, the fuel expense decreases.

EXAMPLE 2

A vehicle having the vehicle system of the present invention is driven to test changing ratios (Cm) of the pedal, rotation number (rpm) and fuel expense (Km/l) as shown in Table 2.

TABLE 2

| Changing Ratio of Pedal (Cm) | Rotation Number (rpm) | Fuel Expense (Km/l) |
|---|---|---|
| 0.2 | 1000–1400 | 8.25 |
| 0.5 | 1400–1800 | 9.5 |
| 0.8 | 1800–2000 | 10.0 |
| 1.1 | 2000–2400 | 11.9 |
| 1.4 | 2400–2800 | 8.5 |
| 1.8 | 2800–3200 | 7.0 |
| 2.2 | 3200–4000 | 6.0 |

When the driver depresses the accelerator pedal to a depth of 0.3 Cm, the number of rotations increases to 1400 rpm and gradually, further increases according to the depth of the pedal. When the accelerator pedal moves to a depth of 0.8~1.1 Cm, the fuel expense increases to 11.9 Km/l.

As shown in Tables 1 and 2, in the conventional muffler system, the driver depresses the accelerator pedal to a depth of 1.0 Cm to produce a speed of 80~90 Km/h. However, in the vehicle muffler system according to the present invention, the driver depresses the accelerator pedal to a depth of 0.5 Cm to produce a speed of 80~90 Km/h. Accordingly, the vehicle muffler system according to the present invention provides a substantial savings in fuel consumption while achieving strong engine power.

Figure 5:
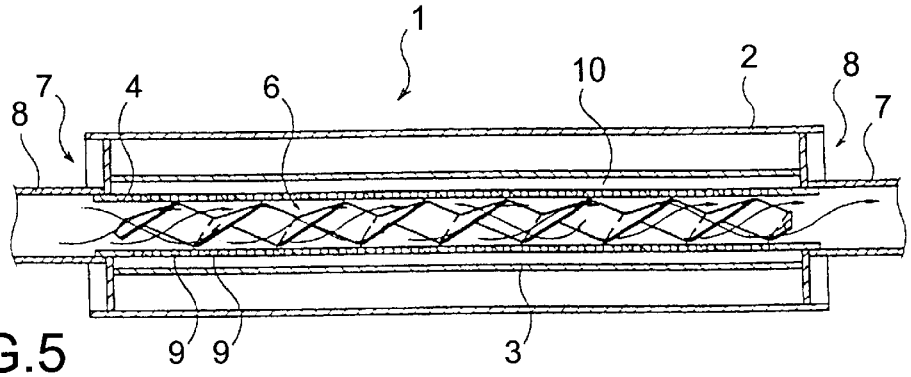
FIG. 5 is a sectional view of a second embodiment of the present invention.

Referring to FIG. 5, the vehicle muffler system according to the present invention shows a second embodiment wherein the submuffler does not include an insulating material which achieves the benefits of a light-weight product and reduced manufacturing costs.

Referring to FIG. 6, the vehicle muffler system according to the present invention shows a third embodiment which does not include the use of a resonator 10.

Figure 7:
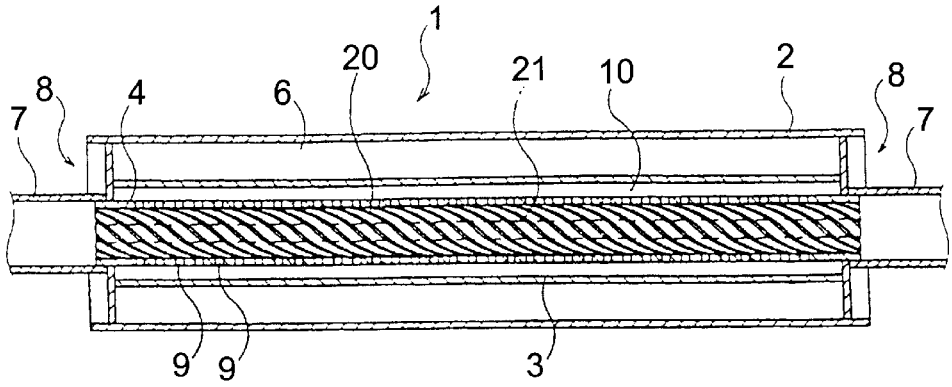
FIG. 7 is a sectional view of a fourth embodiment of the present invention.
Figure 8:
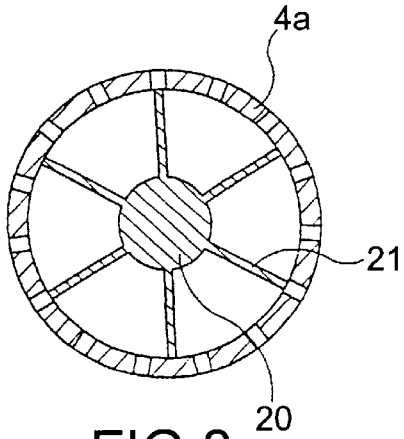
FIG. 8 is a cross-sectional view of FIG. 7.
Figure 9:
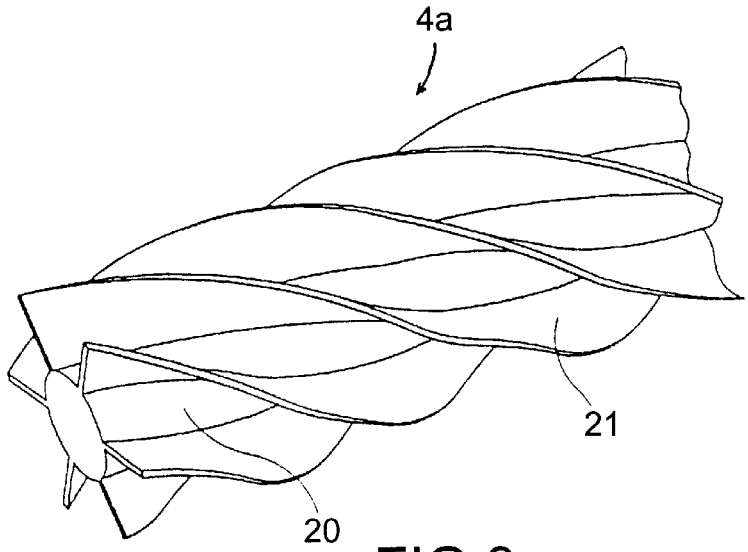
FIG. 9 is a perspective view of the eddy-generating member of the submuffler of the present invention.

FIGS. 7, 8 and 9 of the vehicle muffler system according to the present invention show the use of another type of eddy-generating member 4*a* for accelerating the swirl of air flow of the exhaust gas. The eddy-generating member 4*a* contains an axial rod 20 and a plurality of spiral vanes or fins 21 for producing a vigorous swirling action so as to exhaust the exhaust gas strongly and quickly.

Accordingly, the vehicle muffler system according to the present invention has the following advantages. First of all, the output of the vehicle engine 50 is increased since the exhaust gas can be exhausted quickly due to swirl of the exhaust gas and low pressure of the exhaust gas when the exhaust gas goes through the submuffler 1 of the present invention. Secondly, a vehicle having the vehicle muffler system of the present invention can provide increased safety since a vehicle can pass other cars and climb hills easily and quickly due to a strong engine performance with a corresponding savings in fuel when the driver depresses the accelerator pedal to a depth of 0.5 Cm. Thirdly, the vehicle muffler system according to the present invention increases the exhaust efficiency ratio of the exhaust gas, whereby the air-fuel mixture achieves complete combustion, thereby reducing air pollution.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A submuffler for a vehicle muffler system which comprises, a housing, a pressure-reducing conduit disposed within said housing, said pressure-reducing conduit containing a plurality of apertures disposed on the surface thereof, an eddy-generating member disposed within the pressure-reducing conduit along a substantial length thereof, the eddy-generating member comprising a plurality of fins, each fin having a serpentine configuration disposed in parallel to each other, and pipe means connected to an inlet side and an exit side of the housing for introducing exhaust gas thereto and exiting exhaust gas therefrom.

2. The submuffler of claim 1, wherein the eddy-generating member has a serpentine configuration along its substantial length.

3. The submuffler of claim 2, wherein the eddy-generating member comprises a plurality of fins, each fin having a serpentine-configuration disposed in parallel to each other.

4. The submuffler of claim 1, wherein an insulating material is disposed between the housing and the pressure-reducing conduit.

5. The submuffler of claim 1, wherein the pressure-reducing conduit is surrounded by a resonator and an insulating material is disposed between the housing and the resonator.

6. The submuffler of claim 1, wherein the pressure-reducing conduit is surrounded by a resonator.

7. A vehicle muffler system containing a main muffler, a catalytic converter, and a submuffler disposed between the catalytic converter and the main muffler, said submuffler comprising:

a housing, a pressure-reducing conduit disposed within said housing, said pressure-reducing conduit containing a plurality of apertures disposed on the surface thereof, an eddy-generating member disposed within the pressure-reducing conduit along a substantial length thereof, the eddy-generating member comprising a plurality of fins, each fin having a serpentine configuration disposed in parallel to each other, and pipe means connected to an inlet side and an exit side of the housing for introducing exhaust gas thereto and exiting exhaust gas therefrom.

8. The system of claim 4, wherein said insulating material wide ring is made of glass fiber.

9. The system of claim 4, wherein said insulating material is made of asbestos.

10. The system of claim 1, wherein said pressure-reducing pipe has a net-type configuration.

* * * * *